US006258221B1

(12) United States Patent
Lin

(10) Patent No.: US 6,258,221 B1
(45) Date of Patent: Jul. 10, 2001

(54) FLAME ADJUSTING DEVICE FOR OXYGEN AND HYDROGEN GENERATOR

(76) Inventor: Wen Chang Lin, No. 115, Lane 320, Gong Yeh 2nd Road, Lin Yuan Hsiang, Kaoshiung Hsien (TW), 832

( * ) Notice: Subject to any disclaimer, the term of this patent is extended or adjusted under 35 U.S.C. 154(b) by 0 days.

(21) Appl. No.: 09/472,623

(22) Filed: Dec. 27, 1999

(51) Int. Cl.[7] ..... C25B 15/00

(52) U.S. Cl. ..... 204/239; 204/265; 204/266; 204/277; 204/278

(58) Field of Search ..... 431/191, 192, 431/193, 203, 12; 60/39.13, 39.19, 39.2, 39.21, 39.27; 204/278, 239, 265, 266, 277

(56) References Cited

U.S. PATENT DOCUMENTS

| | | | | |
|---|---|---|---|---|
| 5,211,828 | * | 5/1993 | Shkarvand-Moghaddam | 204/266 |
| 5,244,558 | * | 9/1993 | Chiang | 204/278 |
| 5,690,797 | * | 11/1997 | Harada et al. | 204/239 |
| 6,068,741 | * | 5/2000 | Lin | 204/239 |

* cited by examiner

*Primary Examiner*—Bruce F. Bell
(74) *Attorney, Agent, or Firm*—Charles E. Baxley

(57) ABSTRACT

A flame adjusting device includes a tank for receiving a fluid and includes an upper portion and a lower portion coupled to a coupler with hoses. The coupler is coupled to a gas generator. A control device is disposed between the coupler and an upper hose and is used for controlling the gas to flow through the hoses and to adjust the gas flowing out of the tank. The gas is a gaseous fuel and is supplied to a facility for generating a flame. The temperature generated by the flame may thus also be adjusted.

5 Claims, 3 Drawing Sheets

FLAME ADJUSTING DEVICE FOR OXYGEN AND HYDROGEN GENERATOR

BACKGROUND OF THE INVENTION

1. Field of the Invention

The present invention relates to a flame adjusting device and more particularly to a flame adjusting device for an oxygen and hydrogen generator.

2. Description of the Prior Art

Typical oxygen and hydrogen generators may be used for generating gaseous fuel, particularly the oxygen and/or the hydrogen. The gaseous fuel generated by the generators may be supplied to a torch, for example, for generating a flame to conduct cutting or welding process. The gaseous fuel and thus the flame may not be adjusted.

The present invention has arisen to mitigate and/or obviate the afore-described disadvantages of the conventional oxygen and hydrogen generators.

SUMMARY OF THE INVENTION

The primary objective of the present invention is to provide a flame adjusting device for adjusting the gaseous fuel from an oxygen and hydrogen generator and in order to adjust the flame generated by the gaseous fuel.

In accordance with one aspect of the invention, there is provided a flame adjusting device for a gas generator, the flame adjusting device comprising a tank for receiving a fluid and including an upper portion and a lower portion, a coupler coupled to the gas generator, a first hose and a second hose coupling the lower portion and the upper portion of the tank to the coupler respectively for receiving a gas from the gas generator, and means for controlling the gas to flow through the first hose and the second hose and for adjusting the gas from the gas generator and for adjusting the flame generated by the gas from the gas generator.

The controlling means includes a control valve provided between the coupler and the second hose for controlling the gas to flow through the first hose and the second hose. The tank includes an indicator for indicating a level of the tank. A facility is coupled to the tank for receiving the gas from the tank in order to generate a flame.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
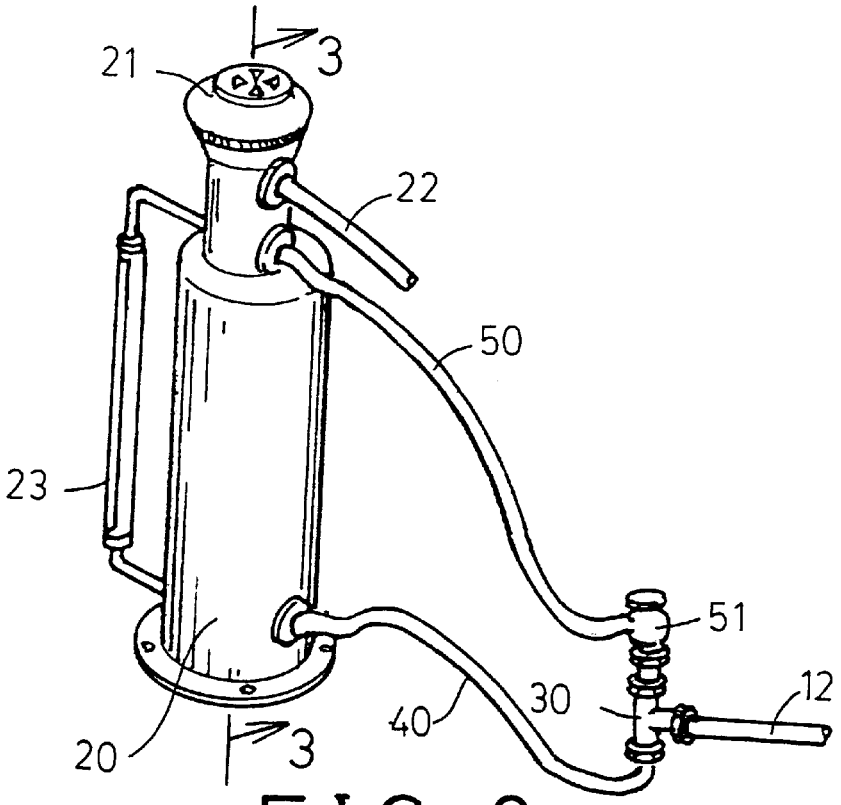
FIG. 2 is a perspective view of the flame adjusting device.
Figure 1:
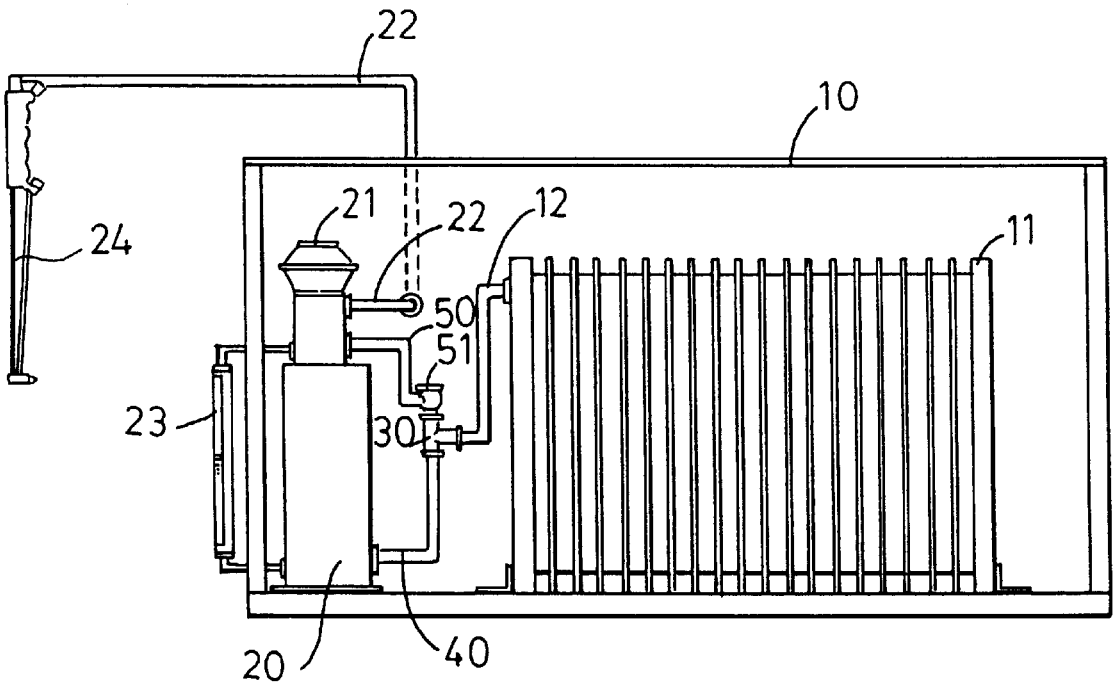
FIG. 1 is a plane view of an oxygen and hydrogen generator having a flame adjusting device in accordance with the present invention.
Figure 3:
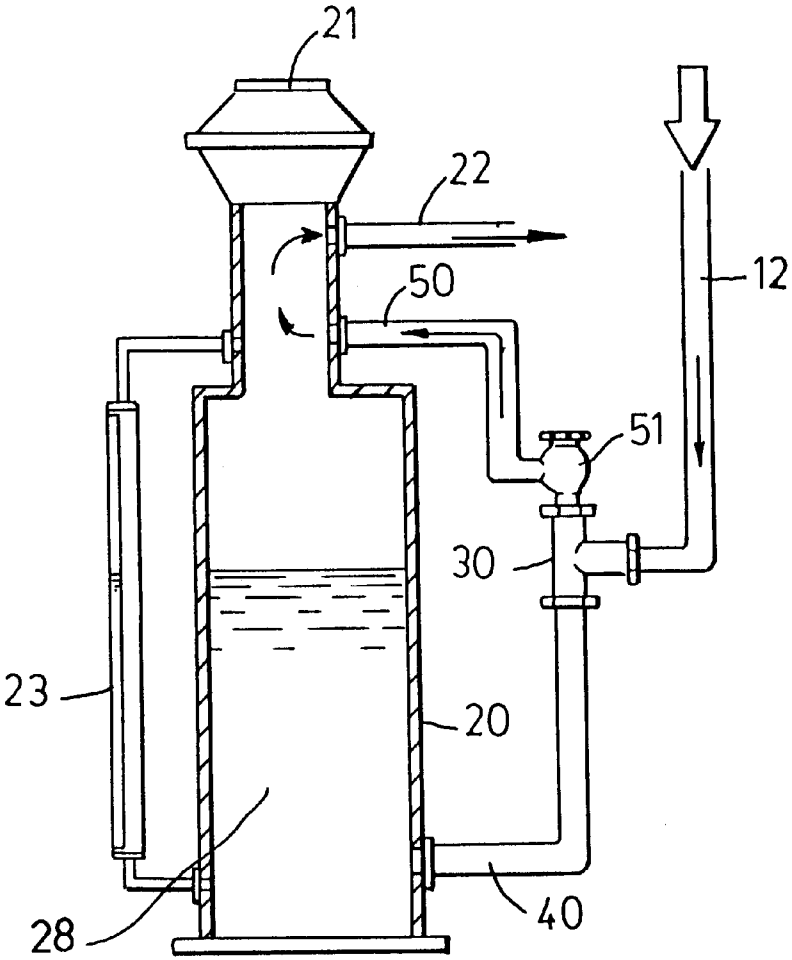
FIG. 3 is a cross sectional view taken along lines 3–3 of FIG. 2.

Referring to the drawings, and initially to FIGS. 1–3, a flame adjusting device in accordance with the present invention is provided and coupled to a nozzle 12 of an oxygen and hydrogen generator 11 for receiving the gaseous fuel, such as the oxygen and/or the hydrogen. One example of the oxygen and hydrogen generator 11 is disclosed in a co-pending U.S. patent application Ser. No. 09/145,456, filed on Sep. 2, 1998 and is taken as a reference for the present invention. The flame adjusting device and/or the oxygen and hydrogen generator 11 may be disposed in a housing 10 or the like.

The flame adjusting device comprises a tank 20 including a port 21 for adding into or for drawing a fluid 28 from the tank 20 and including an indicator 23 coupled to the side portion for indicating the fluid 28 level in the tank 20. The fluid 28 may be selected from gasoline, alcohol, alkyl group, or alcoholic fluids, etc. Two hoses 40, 50 couple the lower and the upper portions of the tank 20 to a coupler 30, such as a three-way valve, and a control valve 51 is provided between the coupler 30 and the hose 50 for controlling the gaseous fuel through the hoses 40, 50. The tank 20 includes an outlet 22 for supplying the gaseous fuel out to a facility, such as a torch 24 (FIG. 1) and for generating a flame to conduct a welding or cutting process. It is preferable that the hose 50 is coupled to the tank 20 at a position lower than the outlet 22.

Figure 4:
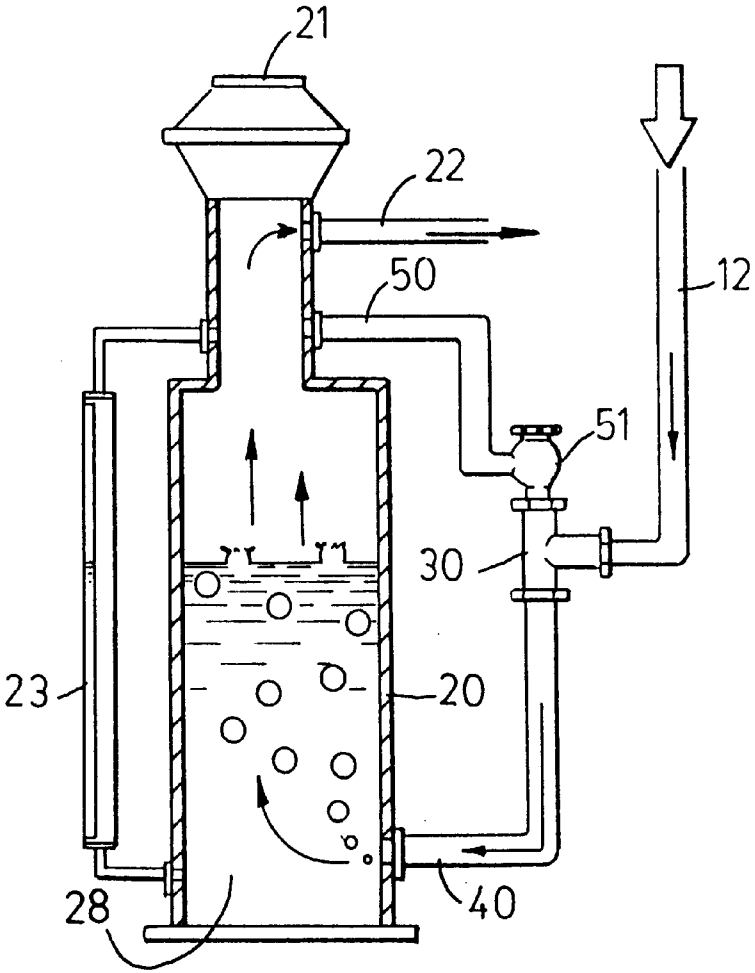
FIGS. 4 and 5 are cross sectional views similar to FIG. 3, illustrating the operation of the flame adjusting device.
Figure 5:
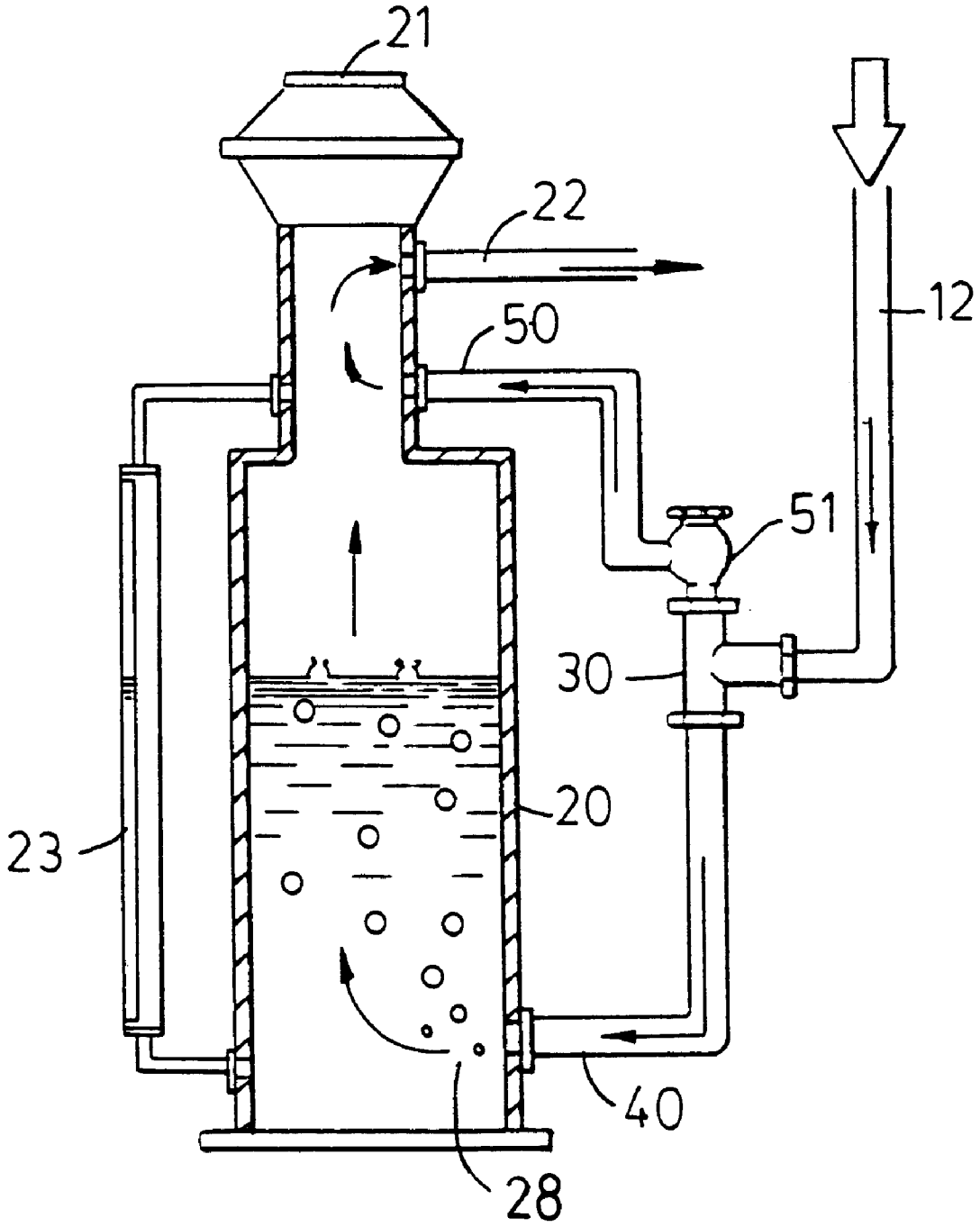

In operation, as shown in FIG. 3, the control valve 51 may control the gaseous fuel to flow to the facility 24 through the hose 50 and the outlet 22 only. The gaseous fuel may generate a flame of a temperature up to 3000° C., depending on the gaseous fuel generated by the generator 11. As shown in FIG. 4, the control valve 51 may control the gaseous fuel to flow to the facility 24 through the hose 40 and the fluid 28 only. The gaseous fuel may be mixed with the fluid 28 to form a mixed gas which generate a flame of a temperature about 900° C., depending on the gaseous fuel and the fluid 28. As shown in FIG. 5, the control valve 51 may control the gaseous fuel to flow to the facility 24 through the hose 40 and the fluid 28 and the hose 50 separately. A portion of the gaseous fuel may be mixed with the fluid 28 to form a mixed gas which generate a flame of a temperature ranging from 900° C. to 3000° C., depending on the gaseous fuel and the fluid 28 and depending on the gaseous fuel flowing through the hoses 40, 50.

Accordingly, the flame adjusting device in accordance with the present invention may be used for adjusting the gaseous fuel from the oxygen and hydrogen generator and may be used to adjust the flame generated by the gaseous fuel.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flame adjusting device for a gas generator, said flame adjusting device comprising:

a tank for receiving a fluid and including an upper portion and a lower portion, and including an outlet, a coupler coupled to the gas generator for receiving a gas generated by the gas generator, a first hose coupling said coupler to said lower portion of said tank for allowing the gas from the gas generator to flow into said tank and to flow through the fluid received in said tank and to flow out through said outlet of said tank, and a second hose coupling said coupler to said upper portion of said tank for allowing the gas from the gas generator to directly flow into said tank, without flowing through the fluid received in said tank, and to flow out through said outlet of said tank together with the gas flowing through the fluid received in said tank.

2. The flame adjusting device according to claim 1 further comprising means for controlling the gas to flow through said first hose and said second hose.

3. The flame adjusting device according to claim 2, wherein said controlling means includes a control valve provided between said coupler and said second hose for controlling the gas to flow through said first hose and said second hose.

4. The flame adjusting device according to claim 1, wherein said tank includes an indicator for indicating a level of said tank.

5. The flame adjusting device according to claim 1 further comprising a facility coupled to said tank.

* * * * *